US011398152B2

(12) United States Patent
Wang

(10) Patent No.: US 11,398,152 B2
(45) Date of Patent: Jul. 26, 2022

(54) CROSS TRAFFIC ASSISTANCE AND CONTROL

(71) Applicant: Volvo Car Corporation, Gothenburg (SE)

(72) Inventor: Wei Wang, Shanghai (CN)

(73) Assignee: Volvo Car Corporation, Gothenburg (SE)

( * ) Notice: Subject to any disclaimer, the term of this patent is extended or adjusted under 35 U.S.C. 154(b) by 3 days.

(21) Appl. No.: 17/168,343

(22) Filed: Feb. 5, 2021

(65) Prior Publication Data

US 2021/0248906 A1 Aug. 12, 2021

(30) Foreign Application Priority Data

Feb. 7, 2020 (CN) ..... 202010082524.5

(51) Int. Cl.
*G08G 1/0962* (2006.01)

(52) U.S. Cl.
CPC ..... *G08G 1/0962* (2013.01)

(58) Field of Classification Search
CPC ... G08G 1/0962; G08G 1/0967; G08G 1/0968
See application file for complete search history.

(56) References Cited

U.S. PATENT DOCUMENTS 9,818,299 B1 11/2017 Jammoussi et al.
2013/0018572 A1* 1/2013 Jang ..... G08G 1/164 701/119
2013/0304365 A1* 11/2013 Trombley ..... G08G 1/166 701/117
2015/0046038 A1* 2/2015 Kawamata ..... G08G 1/09623 701/41
2016/0280134 A1* 9/2016 Miura ..... G08G 1/04
2018/0174449 A1 6/2018 Nguyen
2018/0204450 A1 7/2018 Song et al.
2019/0389465 A1* 12/2019 Ogino ..... B60W 30/18009

OTHER PUBLICATIONS

Jun. 16, 2021 Extended European Search Report issued in International Application No. 202010082524.5.

* cited by examiner

*Primary Examiner* — Sisay Yacob
(74) *Attorney, Agent, or Firm* — Clements Bernard Walker; Christopher L. Bernard

(57) ABSTRACT

An in-vehicle device for controlling a host vehicle to pass through one or more intersections. The in-vehicle device includes a controller configured to obtain information of an intersection through which one or more vehicles including the host vehicle will pass; identify any of the vehicles that will pass through a same intersection as the intersection through which the host vehicle will pass based on the obtained information; determine a priority level of the host vehicle based on an order of the distances between the intersection and the vehicles sharing the right-of-way of the intersection; judge whether the distance between the host vehicle and the intersection is shorter than or equal to a distance threshold; if that the judgment is positive, the priority level of the host vehicle is enabled; if the judgment is negative, the priority level of the host vehicle is disabled.

17 Claims, 5 Drawing Sheets

CROSS TRAFFIC ASSISTANCE AND CONTROL

CROSS-REFERENCE TO RELATED APPLICATION

This disclosure claims the benefit of priority of co-pending Chinese Patent Application No. 202010082524.5, filed on Feb. 7, 2020, and entitled "CROSS TRAFFIC ASSISTANCE AND CONTROL," the contents of which are incorporated in full by reference herein.

TECHNICAL FIELD

This disclosure relates to an in-vehicle device and a method for vehicle assistance and control at intersections.

BACKGROUND

In the prior art, when vehicles driven by human drivers pass through an intersection having no traffic guidance, the human drivers often coordinate with each other by means of observation, gesture or default rules. Traffic accidents occur frequently at intersections and adjacent areas where several traffic flows converge, resulting in traffic interference and declined passing capacity.

When an autonomous driving vehicle passes through an intersection having no traffic guidance, it often adopts such a solution, that is, tracking surrounding traffic information continuously by means of in-vehicle sensing devices and controlling movements of the vehicle by an in-vehicle controlling device based on the tracked information, so that the vehicle may pass through the intersection without collision. Thus, sensors with strong sensing capability and a controller with strong computing capability are needed in a vehicle. The existing solutions are costly since the sensors and controller with powerful functions are expensive. Moreover, in the existing solution, potential dangers may be caused by a sensing failure or a controlling failure.

Therefore, it is desired to provide a technical solution to solve the above problems.

SUMMARY

In view of the above problems in the prior art, this disclosure aims to provide an improved technical solution for controlling vehicles in autonomous driving mode to pass through intersections having no traffic guidance to reduce the cost and improve the vehicle safety of passing through the intersection.

According to one aspect of the disclosure, an in-vehicle device for controlling host vehicle to pass through intersections is provided, which includes a controller configured to: obtain information of each intersection through which one or more vehicles including the host vehicle will pass and a distance between each intersection and each of the vehicles that will pass through said intersection; identify any of the vehicles that will pass through a same intersection as the intersection through which the host vehicle will pass based on the obtained information, the identified vehicle as well as the host vehicle being defined as vehicles sharing the right-of-way of the intersection; determine a priority level of the host vehicle based on an order of the distances between the intersection and the vehicles sharing the right-of-way of the intersection; judge whether the distance between the host vehicle and the same intersection is less than or equal to a distance threshold; in the case that the judging result is positive, the priority level of the host vehicle is enabled such that the host vehicle passes through the same intersection with the priority level; and in the case that the judging result is negative, the priority level of the host vehicle is disabled.

According to an embodiment, each intersection includes one or more turns, the information of each intersection includes identification information and position information, wherein said identification information includes an intersection identification indicating the intersection and a turn identification indicating a turn of the intersection.

According to an embodiment, the identified vehicle includes one or more vehicles having the same intersection identification as the host vehicle.

According to an embodiment, said order is an ascending or descending order of the distances between the intersection and the vehicles sharing the right-of-way of the intersection.

According to an embodiment, the controller is further configured to: at every predetermined time interval, a new priority level of the host vehicle is re-determined, wherein the new priority level of the host vehicle corresponds to the new distance ordering of the host vehicle based on an ascending sequence of the distances between the vehicles sharing the right-of-way and the same intersection; in the case that the new priority level is different from the previous priority level, calculate a distance difference between the new distance corresponding to the new priority level and the distance corresponding to the next lower or higher priority level compared to the new priority level; in the case that the distance difference meets the following conditions, enable the new priority level of the host vehicle: (1) the distance difference is greater than a distance difference threshold; and (2) the distance difference is maintained for a predetermined time period; and when either one of the above conditions is not met, maintain the previous priority level of the host vehicle.

According to an embodiment, the in-vehicle device includes a communication interface communicatively connected with the controller; the in-vehicle device is configured to receive identifications and positions of the intersections through which the host vehicle will pass via the communication interface, and to receive identifications of the intersections through which the one or more other vehicles will pass.

According to an embodiment, the host vehicle is wirelessly communicated with the one or more other vehicles.

According to an embodiment, the in-vehicle device is configured to receive the priority levels of the vehicles sharing the right-of-way via the communication interface; and the controller is further configured to: judge whether there is a priority level higher than the priority level of the host vehicle based on the received priority levels; if it is judged there is a higher priority level, control the host vehicle to brake and wait the vehicle having the higher priority level to pass the same intersection, and then enable the host vehicle to pass the same intersection; and if it is judged that there is no higher priority level, enable the host vehicle to pass the intersection with its priority level.

According to an embodiment, the in-vehicle device is configured to receive a navigation path for guiding autonomous driving via the communication interface, the navigation path including identifications and positions of the intersections through which the host vehicle will pass; or the in-vehicle device is configured to receive identifications and positions of the intersections through which the host vehicle will pass, and a navigation path is calculated based on the identifications and positions at the host vehicle.

According to an embodiment, the navigation path is a parking navigation path for assisted automatic parking.

According to an embodiment, the in-vehicle device is configured to receive vehicle types of the one or more other vehicles via the communication interface, and the controller is configured to: determine whether there is a special-use vehicle based on the vehicle types; if it is judged there is a special-use vehicle, control the host vehicle to wait until the special-use vehicle passes through the intersection; and if it is judged there is no special-use vehicle, control the host vehicle to pass the intersection without waiting.

According to an embodiment, the special-use vehicle is a vehicle used for special and/or emergency tasks.

According to an embodiment, the special-use vehicle includes fire engine, ambulance, police vehicle, engineering rescue vehicle and vehicle used for transporting emergency materials.

According to an embodiment, identifications of intersections are provided by a navigation map which is stored in an external device.

According to an embodiment, the external device is a remote server wirelessly communicated with the host vehicle, or a roadside facility wirelessly communicated with the host vehicle.

According to an embodiment, the distance between the host vehicle and the same intersection is calculated by the controller and sent to the other vehicles wirelessly communicated with the host vehicle via the communication interface; or the distance between the host vehicle and the same intersection is calculated by an external device wirelessly communicated with the host vehicle and transmitted to the host vehicle from the external device, and then sent to the other vehicles from the host vehicle; or the distance between the host vehicle and the same intersection is calculated by an external device and transmitted to the host vehicle and the other vehicles from the external device.

According to an embodiment, after the host vehicle passes the same intersection, the in-vehicle device is configured to control the host vehicle to pass through the next intersection; once the host vehicle passes the same intersection, the priority level of the host vehicle is set to a priority level for the next intersection.

According to an embodiment, the host vehicle and the other vehicles are autonomous driving vehicles; or the host vehicle and the other vehicles are equipped with a driving assistance system for autonomous driving.

According to an embodiment, a vehicle passing through an intersection means that the vehicle turns or goes straight at a turn of the intersection and pass through the intersection; and a distance between a vehicle and an intersection refers to a distance between the front end of the vehicle and a turn of the intersection.

According to an embodiment, a distance between a vehicle and an intersection refers to a distance between the middle of the front end of the vehicle and a central point of a turn of the intersection, and the central point of the turn is the intersection point of a midline of the current lane of travel and a midline of a future lane of travel forming the turn.

According to another aspect of the disclosure, a system for Internet of Vehicle is provided. The system includes two or more vehicles wirelessly communicated with each other, and each of the vehicles is provided with an in-vehicle device as described above to control the vehicle to pass through intersections.

According to yet another aspect of the disclosure, a method for controlling host vehicle to pass through intersections is provided, which can be executed by the in-vehicle device as described above or the system as described above, the method including: obtain identifications of intersections through which vehicles including the host vehicle and one or more other vehicles will pass and a distance between each of the vehicles and a corresponding intersection; identify the vehicles that will pass through the same intersection as the host vehicle based on the identifications, the identified vehicles as well as the host vehicle being referred to as "vehicles sharing the right-of-way"; determine a priority level of the host vehicle to pass through the same intersection, wherein the priority level of the host vehicle corresponds to the distance ordering of the host vehicle based on an ascending sequence of the distances between the vehicles sharing the right-of-way and the same intersection; judge whether the distance between the host vehicle and the same intersection is less than or equal to a distance threshold; in the case that the judging result is affirmative, the priority level of the host vehicle is enabled such that the host vehicle passes through the same intersection with the priority level; and in the case that the judging result is negative, the priority level of the host vehicle is disabled.

According to embodiments of the disclosure, the controlling solution for controlling the vehicle to pass through intersections having no traffic guidance are completed with "zero sensing operation" on the vehicle side, and thus the expensive high-performance in-vehicle sensors are no longer required and the cost can be reduced.

According to embodiments of the disclosure, the parameters used in the analysis and judgment (for example, the intersection identification) are obtained from an external device without querying or calculating on the vehicle side, which greatly reduces the complexity of the controlling solution and improves the traffic management efficiency.

According to embodiments of the disclosure, the same intersection information in a navigation map stored outside the vehicle is broadcasted among vehicles such that all vehicles have the same information. Each vehicle also obeys the same control mechanism when communicating with other vehicles, and adopts the same measurement and calculation method using the parameters with the same physical meaning. Therefore, the reliability and accuracy of the autonomous driving through an intersection having no traffic guidance is achieved.

DETAILED DESCRIPTION

This disclosure relates to a technical solution for cross traffic assistance and control.

In the disclosure, "cross traffic" includes traffic at an intersection, where two or more lanes intersect in the same plane. An intersection in the disclosure includes an intersection having no traffic guidance, that is, the intersection has neither human guidance such as traffic police nor machine guidance such as traffic lights. Intersections may be of various types, such as four-way intersection, T-intersection, Y-intersection and rotary intersection.

In the disclosure, the vehicle "passing through" an intersection means that the vehicle turns or goes straight at the intersection and passes through the intersection.

In the disclosure, the vehicle passes through an intersection in an automatic or autonomous driving mode. Therefore, the vehicle of the disclosure refers to an automatic or autonomous driving vehicle or a vehicle equipped with a driving assistance system to have an automatic or autonomous driving function.

In the disclosure, only one vehicle is allowed to pass an intersection at a time. For example, a two-way road intersects with another two-way road and thus a four-way intersection is formed. Vehicle may come to the four-way intersection with different turn directions at the same time; however, only one vehicle is allowed to pass through the intersection at a time.

In the disclosure, "navigation path" refers to a path for guiding an automatic driving vehicle. The navigation path may be a path between two stopping points for the vehicle, and the vehicle performs automatic driving between the two stopping points. The navigation path is for example a "parking navigation path", that is, a path between a parking position and a drop-off position, wherein "parking position" can be understood as a position within or proximate to the parking space, and "drop-off position" may be a position at which a driver can drop off a vehicle for automatically parking and then retrieve the vehicle from that position.

Some embodiments of the disclosure are further described now.

Figure 1:
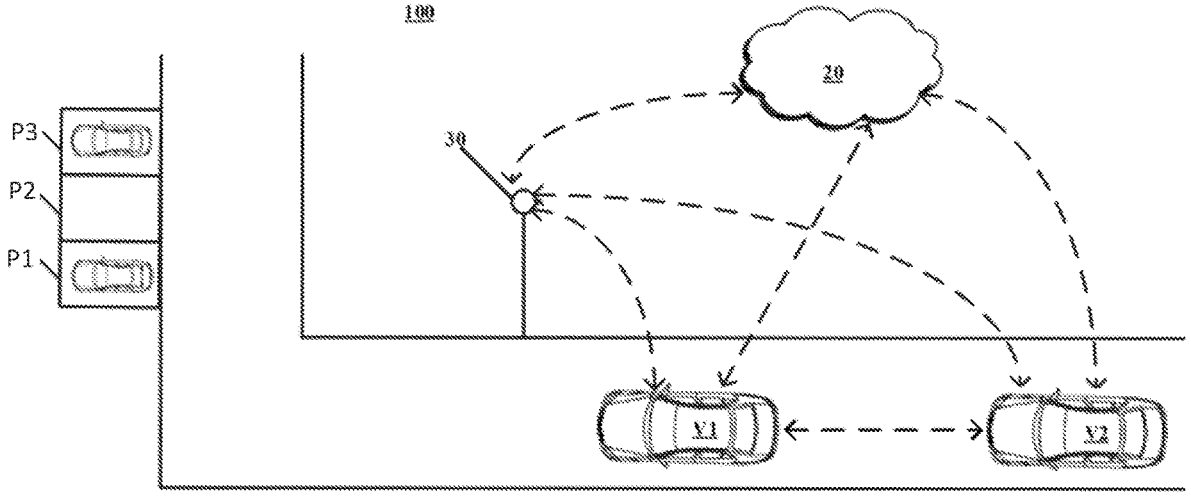
FIG. 1 illustrates an exemplary operating environment in which embodiments of the disclosure may be implemented.
Figure 2:
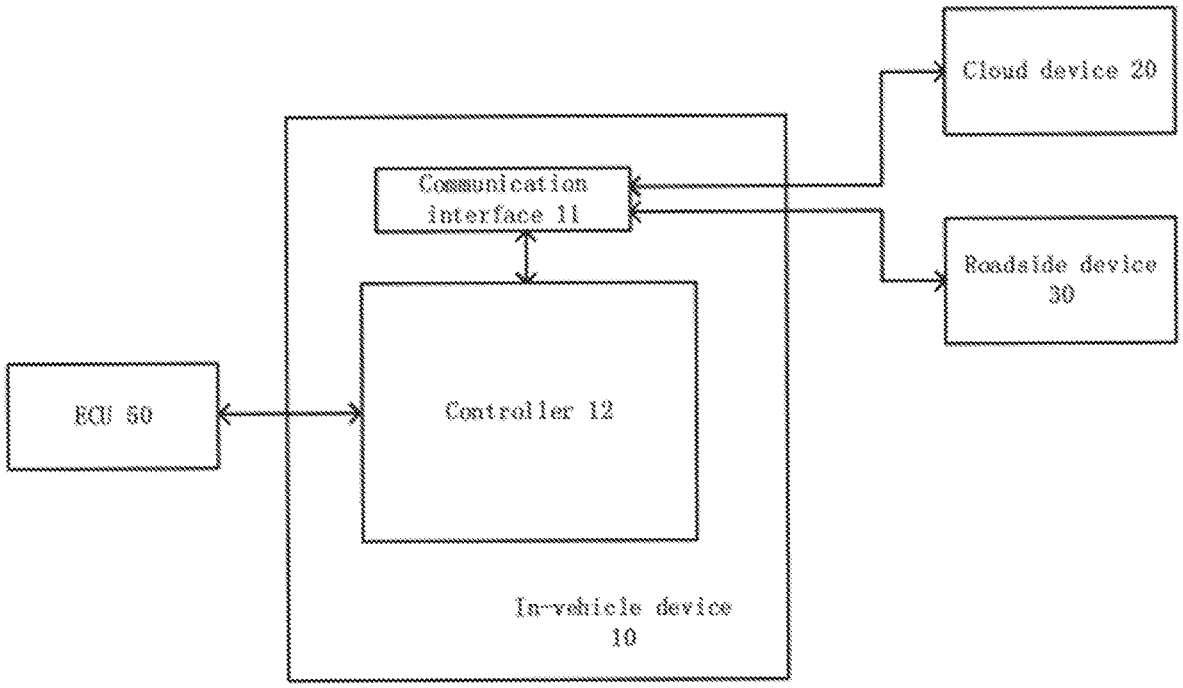
FIG. 2 shows an exemplary function of an in-vehicle device for controlling a vehicle to pass through an intersection.

FIG. 1 illustrates an exemplary operating environment 100 in which some embodiments of the disclosure can be implemented. FIG. 2 illustrates the functions of the in-vehicle device 10 for controlling vehicles to pass through an intersection.

Referring to FIGS. 1 and 2, the operating environment 100 can be a synergetic ecosystem (may also be called an intelligent parking system) for automatic parking, but the disclosure is not limited to the specific framework. In some embodiments, the operating environment 100 may include multiple vehicles V1 and V2 that can communicate with one another, a remote server (e.g., a cloud device) 20 and a roadside facility (e.g., a roadside device) 30. In the operating environment 100, the in-vehicle device 10 is mounted to the vehicle V1, and any two of the in-vehicle device 10, the remote server 20 and the roadside facility 30 can communicate with each other. The operating environment 100 may also include a parking area including multiple parking spots P1-P3.

The in-vehicle device 10 of the vehicle V1, and the remote server 20 (e.g., a cloud device) and the roadside facility (e.g., a roadside device) 30, which each can wirelessly communicate with the vehicle V1, are further described below.

The remote server 20 has data analyzing and processing capability. The remote server can be implemented as a single server or as server arrays or clusters. In some embodiments, the remote server may be deployed on a distributed computing environment and may be implemented by means of cloud computing technology. For example, the remote server may be implemented as a cloud server.

The roadside facility 30 may include roadside sensors, a computing device and a communication unit. The roadside sensors are used for sensing (capturing) traffic condition in a parking area, such as obstacle information around the vehicle. The roadside sensors may include a camera and/or radar (e.g., lidar or millimeter wave radar). The computing device may communicate with the sensors in a wired or wireless manner or a manner of a combined wired and wireless connection. The computing device may be used for analyzing and processing traffic information representing traffic conditions and the traffic information are sensed by the sensors. The computing device is also arranged to integrate with the sensors. The communication unit can also communicate with both the roadside sensors and the computing device. The communication unit may wirelessly transmit (for example, unicast, broadcast) the information sensed by the roadside sensors or the computation result computed by the computing device to a vehicle.

In an embodiment of taking a parking lot as an application scenario for automatic parking, the roadside sensors are disposed at several places in the parking lot to realize no-blind-area coverage of the parking lot. The roadside sensors may transmit sensed traffic information to vehicles in the parking lot, so that parking assist devices (in-vehicle devices) in the vehicles perform identifying and processing to assist the automatic parking. The roadside sensors may also transmit the sensed traffic information to the computing device. The computing device may analyze and process the traffic information and then transmit analyzing and processing results to vehicles in the parking lot to assist the automatic parking.

The in-vehicle device 10 can be an in-vehicle terminal. In one embodiment, the in-vehicle device 10 mainly includes a communication interface 11 and a parking controller 12 communicated with the communication interface 11. The in-vehicle device 10 performs information interaction with the remote server 20 and the roadside facility 30 in a wireless communication manner via the communication interface 11. For example, the in-vehicle device 10 receives information (e.g., instructions and/or data) from the remote server 20 and/or the roadside facility 30 via the communication interface 11, and transmits the information to the parking controller 12. The in-vehicle device 10 may perform information interaction with other vehicles via the communication interface 11. For example, the vehicle V1 receives status information of the vehicle V2 from the vehicle V2 via the communication interface 11 (for example, the status information is broadcasted by the vehicle V2 and includes the intersection identification and the distance from the intersection) and transmits the received status information to the controller 12. The controller 12 controls the manipulations of the vehicle V1 (i.e., the host vehicle V1) based on the received information such that the host vehicle V1 can pass through the intersection.

The controller provides the control strategy for controlling the vehicle to pass through the intersection. The controller 12 may be implemented by means of software or hardware or by a combination of both. The working principle of the controller 12 will be described in detail below.

The in-vehicle device 10 is configured to communicate with one or more components of the vehicle V1. For example, the controller 12 may communicate with the control unit 50 disposed in the vehicle V1. The control unit 50 is, for example, an electronic control unit (ECU).

It is noted that the controller 12 may be disposed in the ECU, i.e., the controlling strategy of the disclosure is realized through the ECU. The parking controller 12 may also be constructed as a controller separated from the ECU and communicated with the ECU.

The in-vehicle device 10 and the remote server 20 may be communicatively coupled via a network which can be implemented as a wireless network, and the wireless network may be based on any wireless communication technologies and/or standards. For example, the network may include telecommunication network provided by telecom operators with any standards. The network may be implemented as a single network, and may also be implemented to include multiple networks. The network may also include Internet of Thing (IoT). Network may also be implemented as a self-organizing wireless network.

The in-vehicle device 10 may communicate peer-to-peer with the roadside facility 30. For example, communications between the in-vehicle device 10 and the roadside facility 30 may be performed by means of V2X network (DSRC/C-V2X), WLAN, infrared (IR) network, Bluetooth network, near field communication (NFC) network or ZigBee network.

Additionally, the vehicle V1, as one node in the operating environment 100, is able to communicate with other nodes in the operating environment 100. Other nodes may include the other vehicle V2, mobile terminals (not shown), etc. For example, the vehicle V1 may interact with the other vehicle V2 in the parking area, i.e., vehicles may perform V2V communications with each other in the parking area.

Figure 3:
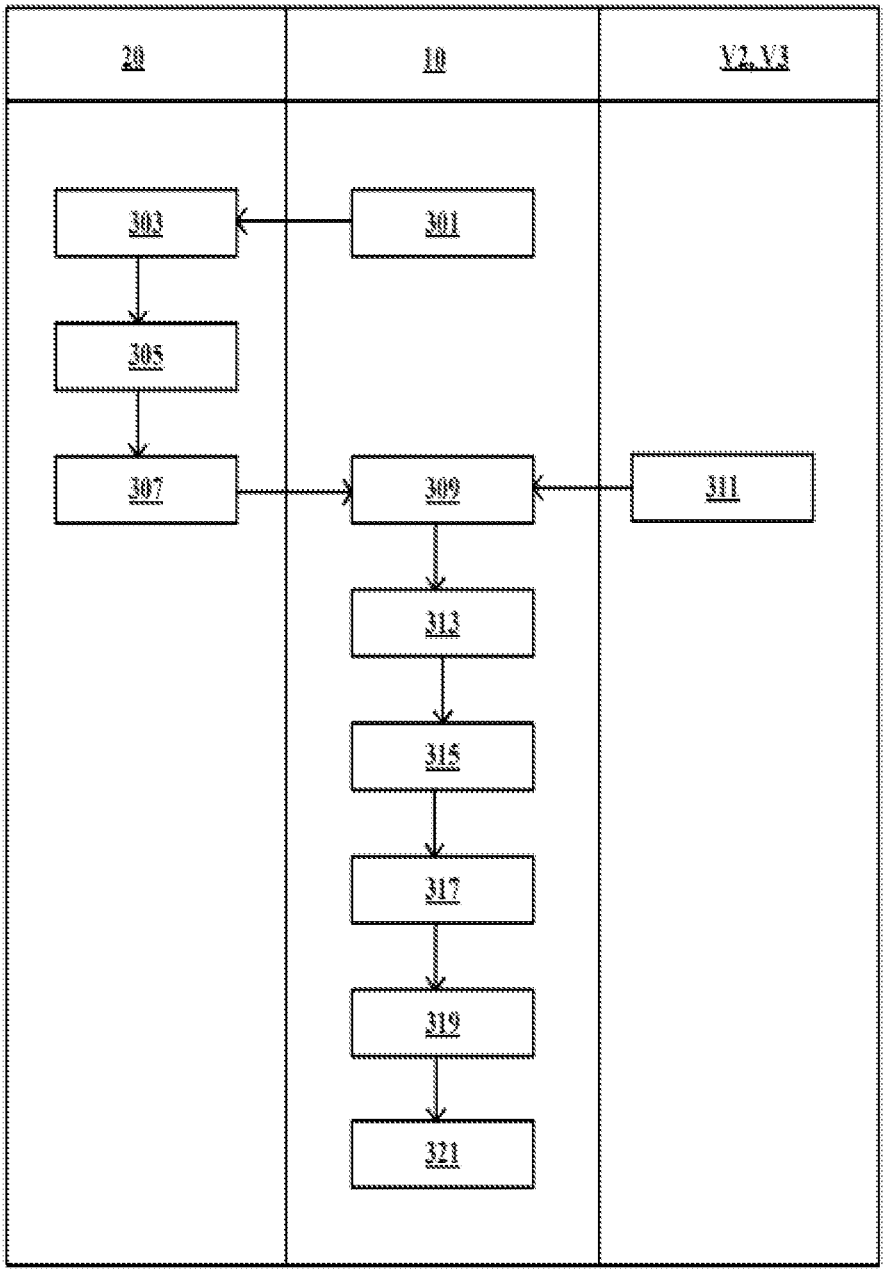
FIG. 3 is a swim-lane diagram illustrating an exemplary communication between the in-vehicle device of the host vehicle and the remote server and other vehicles according to an embodiment of the disclosure.
Figure 4:
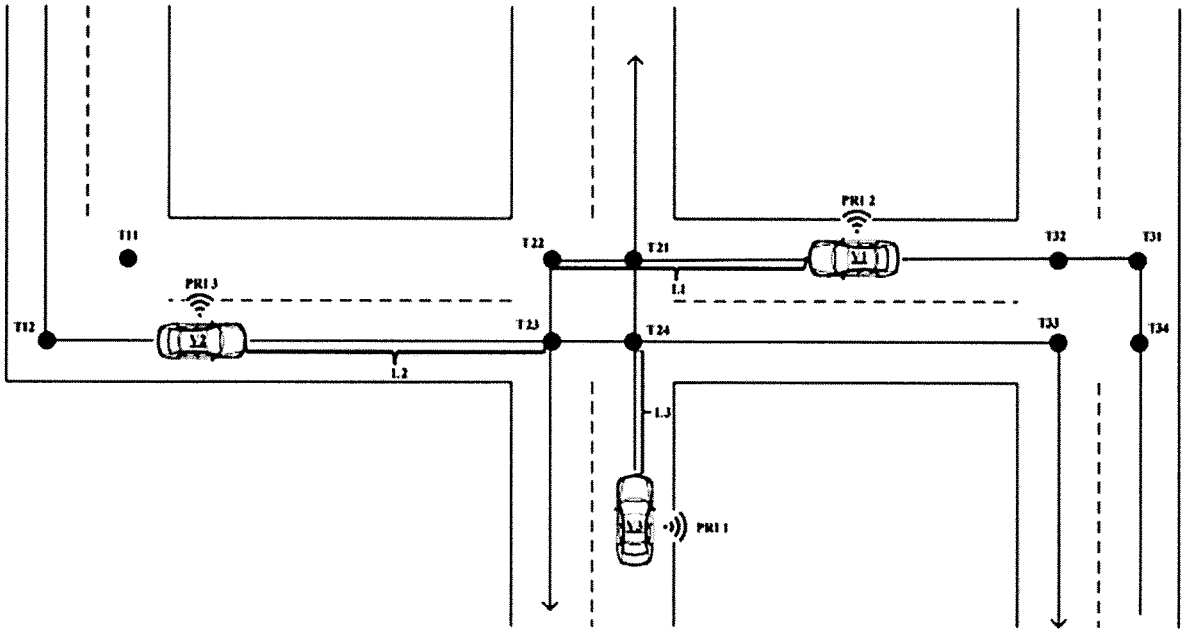
FIG. 4 is a schematic diagram illustrating the working principle of the in-vehicle device according to an embodiment of the disclosure.

FIG. 3 is a swim-lane diagram illustrating an exemplary communication between the in-vehicle device 10 and the remote server 20 and other vehicles V2 and V3 according to an embodiment of the disclosure. FIG. 4 is a schematic diagram for illustrating an exemplary working principle of the in-vehicle device 10. The working principle and process of the in-vehicle device 10 are described below with reference to FIG. 3 and FIG. 4.

First, the host vehicle V1 sends a request to the remote server 20 to request information for assisting the automatic driving (block 301). After receiving the request (block 303), the remote server 20 determines (block 305) assistance information for assisting the automatic driving based on a previously stored navigation map and sends the assistance information to the vehicle V1 (block 307).

The assistance information at least includes intersection information of the intersection through which the vehicle V1 can reach its destination. The intersection information includes an intersection identification of the intersection and intersection position. The assistance information may also include a navigation path having the intersection information. The navigation path is used to guide the vehicle V1 to travel along the path and the vehicle V1 may obtain the intersection information from the path.

The intersection information is provided by a navigation map stored in the remote server 20. The intersection identification and intersection position of each intersection are provided by the navigation map.

In an embodiment, an intersection includes one or more turns, and the identifications for each intersection marked on the navigation map includes two parts, namely, the intersection identification for identifying the intersection and the turn identification for identifying the turns of the intersection. For example, in the case that the second intersection has four turns, the identification of the second intersection is identified as T21-T24 on the navigation map (see FIG. 4).

It is noted that one or more turns of an intersection need to be identified (numbered) according to the same rules. For example, all the turns are identified (numbered) clockwise or all the turns are identified (numbered) counterclockwise, so that a specific intersection or a specific turn can be identified based on the same standard.

It is noted that each turn may be represented by a central point of the turn (see T11-T12, T21-T24, and T31-T34 shown in FIG. 4). The central point may be the intersection point of the two midlines of the two traffic lanes forming the turn. For example, the central point T22 is the intersection point of the midline of the travelling lane along T22 and T23, and the midline of the travelling lane along T11 and T31.

It is noted that the navigation path may also be calculated by the vehicle V1. For example, at the vehicle V1, the intersection information is received through the communication interface 11, and a navigation path for traversing these intersections is calculated in the vehicle V1 (for example, by the controller 12).

It is noted that a navigation path of a vehicle may be represented by the intersections the vehicle will pass. For example, referring to FIG. 4, the navigation path for the vehicle V1 may be expressed as a path {T31, T22}. Similarly, the navigation path for the vehicle V2 may be expressed as {T12, T23, T33}. The navigation path of the vehicle V3 may be expressed as {T24}.

It is noted that, when a vehicle is passing through an intersection, the vehicle may pass through two or more turns of the intersection. In this case, only one intersection identification (for example, only one turn) is used to represent the intersection.

In an embodiment, when a vehicle goes straight or turns right to pass through an intersection, the intersection is indicated by the identification of the turn where the vehicle passes first. For example, when the vehicle V3 passes through the intersection "2", it will pass through the turns T24 and T21 in turn. In this case, the intersection is represented by the turn T24 where the vehicle V3 passes first.

In another embodiment, when the vehicle turns left to pass through an intersection, the intersection is indicated by the turn where the vehicle passes at a later time. For example, when the vehicle V1 travels in the lane including the turns T34 and T31 and turns left to pass through the intersection "3", the intersection is represented by the turn T31 where the vehicle V1 passes at a later time. Of course, other ways may also be used to represent the intersection through which the vehicle passes, as long as only one identification is used to represent an intersection, so as to avoid the repeated broadcast of the intersections through which the vehicle passes.

In an embodiment for implementing blocks 301-307, the vehicle V1 may send an automatic parking request to the remote server 20 when it needs automatic parking. After receiving the automatic parking request, the remote server 20 calculates the parking navigation path based on pre-stored information, and the parking navigation path includes intersection information along the path. The pre-stored information may include: (1) a navigation map (e.g., HD map) of the area for the automatic driving; (2) traffic laws and regulations, for example, the vehicle V1 should travel along the right-hand side or the left-hand side according to the current traffic regulations, and route regulations of the current parking area (e.g., a parking lot).

In addition, the other vehicles V2 and V3 can send their respective status information to the vehicle V1 (block 311). The vehicle V1 receives the status information of the other vehicles (block 309) via the communication interface 11 as the assistance information for automatic driving. The received status information includes the intersection identifications of the intersections through which the other vehicles will pass and the distance between each of the other vehicles and an intersection the vehicle is approaching. For example, the status information sent by the vehicle V2 includes that the vehicle V2 will pass through the intersection T23 and the distance between the intersection T23 and the vehicle V2 is L2. The status information sent by the vehicle V3 includes that the vehicle V3 will pass through the intersection T24 and the distance between the intersection T24 and the vehicle V3 is L3.

In an embodiment, each of the vehicles V1-V3 sends (broadcasts) the intersection identifications of the intersections it will pass, the distance between the vehicle and an approaching intersection. For example, the vehicle V1 broadcasts the identification T22 and the distance L1 to vehicles V2 and V3. The vehicle V2 broadcasts the identification T23 and the distance L2 to vehicles V1 and V3. The vehicle V3 broadcasts the identification T24 and the distance L3 to vehicles V1 and V2.

In this way, the in-vehicle device 10 of the vehicle V1 receives (block 309) the assistance information used for assisting the automatic driving through the communication interface 11. The assistance information may include the intersection identification and intersection position of the intersection that the host vehicle will pass, and the intersection identifications of the intersections that other vehicles will pass, as well as the distances between the other vehicles and the intersections.

It is noted that the distance between the vehicle V1 and the intersection it will pass may be obtained in a number of ways.

In an embodiment, the distance between the vehicle V1 and the intersection it will pass may be monitored and calculated by the remote server 20 in real time, and then sent to each vehicle from the remote server. In this embodiment, the calculation and transmission of the distance are completely realized by the remote server.

In another embodiment, the distance between the vehicle V1 and the intersection it will pass may be monitored and calculated by the remote server 20 in real time, and then sent to the vehicle V1 from the remote server, and then sent to the surrounding vehicles from the vehicle V1. For example, the distance is monitored, calculated and sent from the remote server 20 in real time, and then received by the vehicle V1 through the communication interface 11, and then sent to the surrounding vehicles through the communication interface 11 from the vehicle V1. In this embodiment, the calculation and transmission of the distance are realized by the remote server and the vehicle jointly.

In yet another embodiment, the distance between the vehicle V1 and the intersection it will pass may be calculated at the vehicle V1 (for example, the controller 12 of the vehicle V1) based on the position of the intersection and the current position of the vehicle, and sent to the surrounding vehicles from the vehicle V1 via the communication interface 11. In this embodiment, the calculation and transmission of the distance are completely realized by the vehicle V1.

It is noted that, for each vehicle, the distance between a vehicle and an intersection should calculated and transmitted using a uniform standard. For example, the same rule should be applied to determine the two endpoints measuring the distance. For example, the distance between the vehicle and the intersection refers to the distance between the front end of the vehicle and the straight passing point or the turn point at which the vehicle passes through the intersection. The straight passing point refers to the central point of the turn used to represent the intersection when the vehicle goes straight to pass through the intersection. The turn point refers to the central point of the turn used to represent the intersection when the vehicle turns left or right to pass through the intersection. For example, the distance L1 is the distance between the midpoint of the front end of the vehicle V1 and the turn T22 when the vehicle V1 is driving along the midline of traffic lane to pass through the intersection "2", where the turn T22 is indicated by a central point of the turn T22, that is, the intersection point of the midline of the travelling lane of the vehicle V1 and the midline of the traffic lane along T22 and T23.

It is noted that the operations performed by the remote server 20 as described above may also be performed by the roadside facility 30 (e.g., a computing device in the roadside facility 30) and transmitted to the vehicle via a communication unit of the roadside facility 30.

The information for assisting the automatic driving may be obtained from the remote server 20 and received by the vehicle V1 through the communication interface 11. The information may also be obtained from the roadside facility 30 and received by the vehicle V lthrough the communication interface 11. The remote server and roadside facility are located outside the vehicle V1, which may be collectively referred to as external devices. Therefore, according to embodiments of the disclosure, the in-vehicle device 10 receives information for assisting the automatic driving from an external device via the communication interface 11.

Then, the controller 12 controls the vehicle V1 to pass through the intersection based on the received information.

In block 313, the controller 12 obtains the information of the intersections that the host vehicle V1 and one or more other vehicles V2 and V3 will pass through. The information includes the intersection identifications of the intersections and the distances between each of the vehicles and the intersections. The host vehicle V1 may wirelessly communicate with the one or more other vehicles V2, V3.

For example, the information may include: the vehicle V1 will pass through the intersection T22 and the distance between the vehicle V1 and the intersection T22 is L1; the vehicle V2 will pass through the intersection T23 and the distance between the vehicle V2 and the intersection T23 is L3; the vehicle V3 will pass through the intersection T24 and the distance between the vehicle V3 and the intersection T24 is L3.

In block 315, the controller 12 may identify those vehicles that will pass through the same intersection with the host vehicle V1 according to the intersection identifications, and those vehicles as well as the host vehicle V1 are referred to as the vehicles sharing the right-of-way. The controller 12 may determine the vehicles sharing the right-of-way based on the intersection identifications.

For example, the intersection identification "2" is identified from the information "the host vehicle V1 will pass through the turn T22", and other vehicles with the intersection identification "2" are the vehicles that will pass the same intersection "2". In other words, regardless of whether the identifications of the turns are the same or not, as long as the identifications of the intersections are the same, the vehicle is identified as a vehicle sharing the right-of-way with the host vehicle. For each intersection, regardless of how many turns the intersection has; only one vehicle is allowed to pass the intersection at a time. Referring to FIG. 4, vehicle V2 will pass through the turn T23 and vehicle V3 will pass through the turn T24. The vehicles V2 and V3 as well as the vehicle V1 will be seen as the vehicles sharing the right-of-way (i.e., the vehicles will pass through the intersection "2").

Next, the controller 12 performs a priority allocation strategy (priority allocation mechanism), that is, a priority level is assigned to an automatic driving vehicle such that the vehicle will pass through the intersection according to the assigned priority level.

In block 317, the controller 12 determines a priority level of the host vehicle V1 such that the vehicle V1 may pass through the intersection with the priority level. The priority level assigned to the host vehicle V1 corresponds to the distance ordering of the host vehicle based on an ascending sequence of the distances between the vehicles sharing the right-of-way and the same intersection. For example, if the distance between vehicle V1 and the same intersection is L1, the distance L1 is shorter than the distance L2 and greater than the distance L3. The distance L1 ranks second according to an ascending order of the distances, and the priority level of the host vehicle V1 is 2. The vehicle V1 may broadcast the information of PRI 2. In other words, the shorter the distance between a vehicle and an intersection is, the higher the priority level of the vehicle will be. It means that the vehicle with a higher priority level is prioritized to pass through the intersection first.

Similarly, the distance L2 is ranked third according to an ascending order, the priority level assigned to the vehicle V2 is 3. For example, vehicle V2 may broadcast the information of PRI 3. If the distance L3 ranked first according to an ascending order, the priority level assigned to the vehicle V3 is 1. For example, vehicle V3 may broadcast the information of PRI 1.

In block 319, the controller 12 determines whether the distance between the host vehicle and the same intersection is less than or equal to a distance threshold. The distance threshold is pre-determined, for example, based on empirical and/or mathematical models. The distance threshold is used to determine whether the host vehicle can pass the interaction with the assigned priority level. For example, although the distance between the host vehicle and the intersection is the shortest, hence the highest priority level is assigned to the host vehicle, if the vehicle is still far away from the intersection (greater than the distance threshold), the host vehicle may continue to travel towards the intersection and the assigned priority level is disabled until the distance between the host vehicle and the intersection is less than or equal to the distance threshold. In other words, the priority strategy may be triggered based on the distance threshold.

In block 321, if the controller 12 determines that the distance between the host vehicle and the same intersection is less than or equal to the distance threshold, the host vehicle will pass through the same intersection with assigned priority level. If it is determined that the distance between the host vehicle and the same intersection is greater than the distance threshold, the assigned priority of the vehicle will be disabled until the distance becomes less than or equal to the distance threshold.

In an embodiment, the in-vehicle device 10 also obtains the priority levels of other vehicles (other than the host vehicle) among the vehicles sharing the right-of-way through the communication interface 11. For example, the in-vehicle device 10 also obtains the priority levels of the vehicles V2 and V3. If the controller 12 determines that the distance between the host vehicle and the same intersection is less than or equal to the distance threshold, the controller 12 further determines whether there is a priority level higher than that of the host vehicle V1 based on the received priority levels of the other vehicles V2 and V3. If it is judged that there is a higher priority level, the vehicle V1 will wait and let the vehicle with higher priority level pass the intersection. For example, the controller 12 controls the vehicle V1 to brake and wait until the vehicles with higher priority levels pass the intersection, and then controls the host vehicle to pass the intersection. If it is judged that there is no higher priority level and the distance between the host vehicle V1 and the intersection is less than or equal to the distance threshold, the priority level of the host vehicle is enabled and maintained, that is, the host vehicle is allowed to pass the intersection with the assigned priority level.

It is noted that the host vehicle V1 may receive the priority levels of the other vehicles from each of the other vehicles. The vehicle V1 may also receive the priority levels of the other vehicles from an external device. For example, each of the other vehicles sends the assigned priority level to the external device (a remote server or roadside facility), and then the external device sends the priority levels of the other vehicles to the host vehicle V1.

In an embodiment, the in-vehicle device 10 may also receive the information of vehicle type of other vehicles via the communication interface 11. The information of vehicle type at least includes the information indicating whether a vehicle is a special-use vehicle, that is, according to a vehicle type of a vehicle, it is determined whether the vehicle is a special-use vehicle. The information of vehicle type may be realized in the form of a tag indicating the tagged vehicle is a special-use vehicle. Special-use vehicles may be understood as vehicles used for special services and/or emergency tasks, such as fire engine, ambulance, police vehicle, engineering rescue vehicle, vehicle used to carry emergency materials, etc. Compared with a non-special-use vehicle, a special vehicle has a higher priority level for passing through an intersection, that is, if a special-use vehicle and a non-special-use vehicle pass through the same intersection, the special-use vehicle will be given a higher priority level than other non-special use vehicles to allow it to pass through the intersection first.

After the in-vehicle device 10 obtains the information of vehicle type through the communication interface 11, the controller 12 performs the following operations. Based on the vehicle type, the controller 12 determines whether there is a special-use vehicle among the vehicles sharing the right-of-way. If the controller 12 judges that there is a special vehicle, it controls the vehicle V1 to wait for the special-use vehicle to pass the intersection. If the controller 12 judges that there is no special-use vehicle, the controller 12 controls the host vehicle to pass through the intersection.

It is noted that a special-use vehicle may have the highest priority level, for example, the priority level "0". The special-use vehicle may not have any priority levels, and the default setting of the control strategy is that a special-use vehicle has the highest priority level, that is, when a special vehicle needs to pass an intersection, it will have the right to pass the intersection first.

It is noted that the information of vehicle type may also include the information such as size, model, function and usage of a vehicle.

In one embodiment, the host vehicle V1 is identified as a non-special-use vehicle.

It is noted that the vehicle V1 may receive the information of vehicle type from each of the other vehicles. The vehicle V1 may also receive the information of vehicle type of the other vehicles from an external device. For example, each of the other vehicles sends its vehicle type to an external device (a remote server or roadside facility) and the external device sends the received information of the vehicle type to the host vehicle V1.

In addition, the controller 12 also has a priority rearrangement strategy (priority re-ranking mechanism), that is, if the distance order of the vehicles sharing the right-of-way changes, it is determined whether to enable a new priority allocation corresponding to the new distance ordering.

In block 319, a strategy for determining whether the priority level of the host vehicle V1 has changed can be performed.

In an embodiment of the strategy, the controller 12 determines the priority level of the host vehicle passing through the same intersection at a predetermined interval to obtain a new priority level of the host vehicle. The new priority level of the host vehicle V1 corresponds to the new distance ordering of the host vehicle V1 based on an ascending sequence of the distances between each of the vehicles sharing the right-of-way and the same intersection. If the new priority level changes from the previous priority level, the controller 12 calculates a distance difference between the new distance and the distance corresponding to the neighboring priority level (the next higher or lower priority level). For example, if the new priority level is level 3, the next lower priority level may be level 4, and the next higher priority level may be level 2. When the distance difference satisfies the following two conditions, the controller 12 enables the new priority: (1) the distance difference is greater than a distance difference threshold; (2) the distance difference is maintained for a predetermined time period. If either one of the above two conditions is not satisfied, the controller 12 maintains the previous priority level. The new priority level is ignored.

For example, if the previous distance ordering is L3<L1<L2 and the new distance ordering is L3<L2<L1, the previous priority level of the host vehicle V1 is 2 and the new priority level is 3, and the priority level of the host vehicle V1 has changed. Then, the distance difference between L1, which corresponds to the previous priority level of the host vehicle V1 and L2, which corresponds to the next new priority level of the host vehicle V1, is calculate. If the distance difference is greater than the distance difference threshold and the distance difference is maintained for a predetermined time period, the priority level of the host vehicle V1 will change to the new priority level 3. If the distance difference is smaller than the distance difference threshold (that is, the distance change may be quite small), or the distance difference is not maintain for the predetermined time period (that is, the distance change may be only maintained for a quite short time period), the previous priority level 2 of the host vehicle V1 is still valid, and the new priority level 3 can be ignored.

Further, if a vehicle with a higher priority stops or decelerates, the above strategy can be used to avoid unnecessary wait by the other vehicles sharing the right-of-way in the case that the other vehicles do not know the deceleration or brake. Thus, the priority rearrangement strategy (priority re-ranking mechanism) allows other vehicles to pass an interaction without unnecessary delay.

In addition, after the host vehicle V1 passes through the intersection, the in-vehicle device 10 will immediately enable the control strategy for the next intersection. The working principle and process for the next intersection is similar to the above description, except that, after the host vehicle passes through an intersection, the host vehicle will immediately obtain a priority level for the next intersection according to the above priority allocation mechanism. The priority levels of the host vehicle and other vehicles may change in this process. For example, the priority level of the host vehicle may change from the priority level for the previous intersection to the priority level for the next intersection, or the priority levels of the vehicles travelling towards the next intersection may change because the host vehicle V1 is added to the vehicles sharing the right-of-way to the next intersection. The change is not constrained by the above priority rearrangement mechanism.

In an embodiment, the host vehicle V1 passes through an intersection and is still far from the next intersection, and thus the host vehicle V1 cannot receive the status information of other vehicles that will pass through the next intersection. For example, the distances between the other vehicles that will pass through the next intersection and V1 are beyond V2V communication range. In this case, the host vehicle V1 determines its own priority level as the highest level, for example, the priority level 1. After receiving the status information from the other vehicles, the host vehicle V1 recalculates and re-determines its own priority again according to the above priority allocation mechanism.

In another embodiment, when the host vehicle V1 joins the vehicle sharing the right-of-way for the next intersection, the priority levels of the vehicles (the vehicles that will pass through the next intersection) V4 and V5 (not shown) approaching the next intersection may change and the host vehicle V1 immediately obtains its priority level for the next intersection. In this case, the change of priority level is not constrained by the priority rearrangement mechanism. For example, when the vehicle V1 has not joined the vehicles sharing the right-of-way for the next intersection, the priority level of the vehicle V4 is 1 (PRI 1), and the priority level of the vehicle V5 is 2 (PRI 2). When the host vehicle V1 joins V4 and V5 becomes the vehicle for the next intersection, according to the above priority allocation mechanism (that is, ranking based on distance), the priority level of the vehicle V4 is 1 (PRI 1), and the priority level of the vehicle V1 is 2 (PRI 2), and the priority level of the vehicle V5 is 3 (PRI 3). The changes of the priority levels of vehicle V1 and V5 are not constrained by the priority rearrangement mechanism.

It is seen that, after a vehicle passes an intersection, a new priority level will be assigned to the vehicle immediately. This process can be regarded as an "initial" allocation of priority level, and the change of priority level in this process is not constrained by the priority rearrangement mechanism. In this way, it is ensured that a vehicle always has a priority level, and there will be no collision events due to a missing ranking caused by a vehicle with no priority level.

It is noted that, after a vehicle passes the last intersection (that is, the last intersection of the intersections that the vehicle needs to pass in order to reach its destination), no priority level allocation is need.

This disclosure also provides a system for Internet of Vehicle (not shown). The system includes two or more vehicles wirelessly communicating with each other. Each of the two or more vehicles is an automatic driving vehicle or equipped with a driving assistance system for automatic driving. In the system, each vehicle is equipped with an in-vehicle device, which can be implemented as the in-vehicle device 10 as described above. In the system, each vehicle can implement the control strategy of the controller as described above, that is, each vehicle in the system can be regarded as a node, these nodes are communicated with each other, each node sends its own status information to other nodes (for example, the intersection identification, the distance from the intersection and the priority level), and each vehicle adopts the same rules (for example, the priority allocation mechanism and the priority rearrangement mechanism) to pass through the intersection. It is seen that the vehicles in the system cooperate with each other in the way of distributed control, and all the vehicles in the system can pass through intersections reliably, orderly and efficiently.

Figure 5:
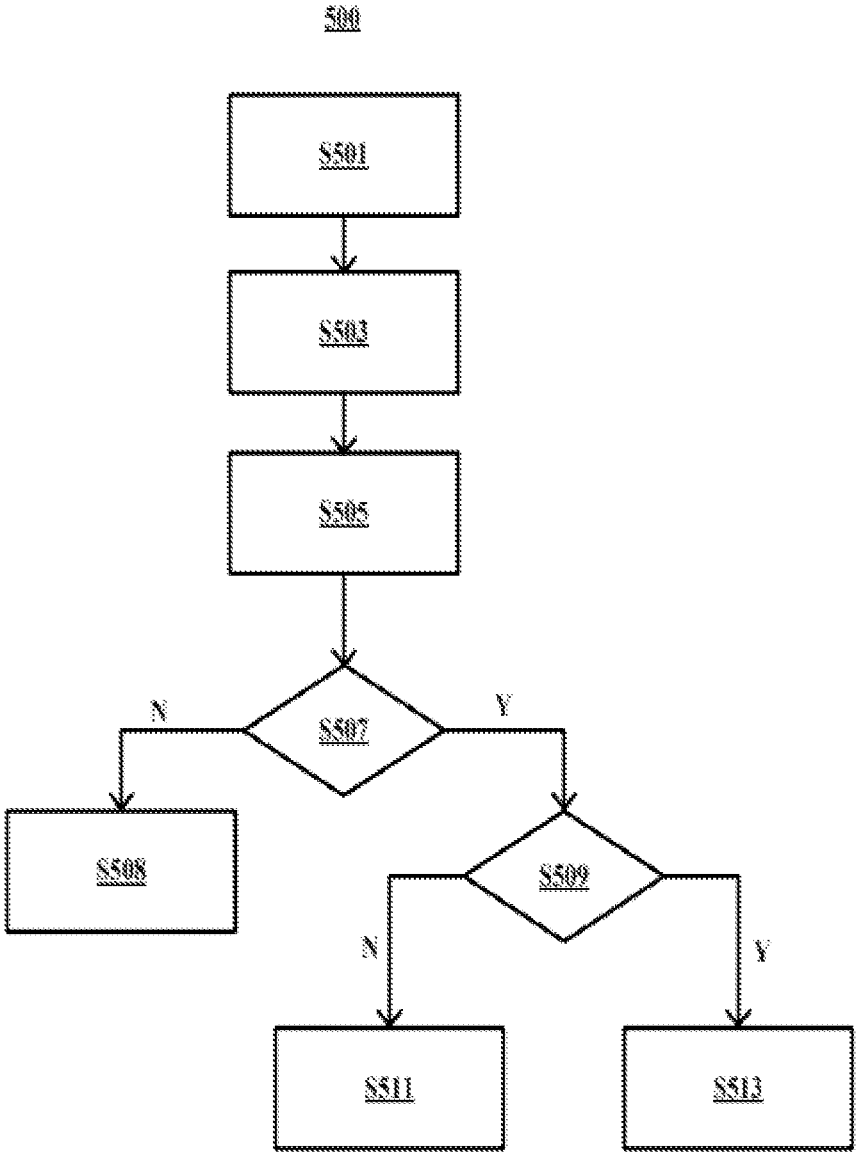
FIG. 5 is a flow chart of a method for controlling a vehicle to pass an intersection according to an embodiment of the disclosure.

FIG. 5 shows a method 500 for controlling a vehicle to pass through an intersection according to an embodiment of the disclosure. The method 500 may be performed by the in-vehicle device 10 or by the system for Internet of Vehicle as describe above. Thus, the features which are described above with reference to the in-vehicle device 10 and the system of Internet of Vehicle are also applicable to the method 500.

In step S501, the information of identifications of intersections and corresponding distances is obtained. The information includes identifications of intersections through which the vehicles including the host vehicle and one or more other vehicles will pass and the distance between each of the vehicles and a corresponding intersection.

In step S503, the vehicles passing through the same intersection as the host vehicle are identified based on the obtained identifications of intersections. The identified vehicles as well as the host vehicle are referred to as the "vehicles sharing the right-of-way".

In step S505, the host vehicle's priority level is determined.

In step S507, whether the distance between the host vehicle and the approaching intersection is less than or equal to a distance threshold is judged.

If the judgment is "NO" in step S507, the method 500 proceeds to step S508. In step S508, the priority level of the host vehicle is disabled.

If the judging result is "YES" in step S507, the method 500 proceeds to step S509. In step S509, a new priority level is obtained. Further, it is judged whether the new priority level is enabled.

If the judging result is "NO" in step S509, the method 500 proceeds to step S511. In step S511, the new priority level is disabled and the previous priority level is enabled.

If the judging result is "YES" in step S509, the method 500 proceeds to step S513. In step S513, the new priority level is enabled.

According to embodiments of the disclosure, the process of controlling a vehicle to pass through an intersection is completed in the case of "zero sensing operation" ON the vehicle side. The expensive high-performance in-vehicle sensors thus are no longer needed and the cost will be reduced.

Moreover, according to embodiments of the disclosure, in the case of passing through an intersection having no traffic guidance, the distributed control can be achieved by means of vehicle to everything communication (V2X) and vehicle to vehicle communication (V2V), such that the vehicle can safely pass through the intersection having no traffic guidance orderly and efficiently.

Moreover, according to embodiments of the disclosure, the parameters (for example, the identifications) involved in the analysis and calculation are obtained without querying or calculating on the vehicle side. Therefore, the complexity of the controlling mechanism is greatly reduced and the traffic control efficiency is improved.

According to embodiments of the disclosure, the same intersection information in a navigation map stored outside the vehicle is broadcasted among vehicles such that all vehicles have the same information. Each vehicle also obeys the same control mechanism when communicating with other vehicles, and adopts the same measurement and calculation method each using the parameters having the same physical meanings. Therefore, the reliability and accuracy of the autonomous driving through an intersection having no traffic guidance is achieved.

While certain embodiments have been described, these embodiments have been presented by way of example only, and are not intended to limit the scope of the disclosure. The attached claims and their equivalents are intended to cover all the modifications, substitutions and changes as would fall within the scope and spirit of the disclosure.

The invention claimed is:

1. An in-vehicle device for controlling a host vehicle to pass through one or more intersections, the in-vehicle device comprising a controller that is configured to:

obtain information of each intersection through which one or more vehicles including the host vehicle will pass and a distance between each intersection and each of the vehicles that will pass through said intersection;

identify any of the vehicles that will pass through a same intersection as the intersection through which the host vehicle will pass based on the obtained information, the identified vehicle as well as the host vehicle being defined as vehicles sharing the right-of-way of the intersection;

determine a priority level of the host vehicle based on an order of the distances between the intersection and the vehicles sharing the right-of-way of the intersection;

judge whether the distance between the host vehicle and the intersection is shorter than or equal to a distance threshold;

in the case that said judgment is affirmative, the priority level of the host vehicle is enabled such that the host vehicle passes through the intersection according to the priority level; and in the case that said judgment is negative, the priority level of the host vehicle is disabled.

2. The in-vehicle device according to claim 1, wherein each intersection includes one or more turns, the information of each intersection comprises identification information and position information, wherein said identification information includes an intersection identification indicating the intersection and a turn identification indicating a turn of the intersection;

the identified vehicle includes one or more vehicles having the same intersection identification as the host vehicle; and said order is an ascending or descending order of the distances between the intersection and each vehicle sharing the right-of-way of the intersection.

3. The in-vehicle device according to claim 1, wherein the controller is further configured to:

re-determine, at a predetermined time interval, a new priority level for the host, wherein the new priority level is based on an ordering of the distance between each vehicle sharing the right-of-way of the intersection and the intersection at the predetermined time interval;

in the case that the new priority level for the host vehicle is different from its previous priority level, calculate a distance difference between the distance of the host vehicle corresponding to the new priority level and the distance of the vehicle sharing the right-of-way of the intersection that has a neighboring priority level;

in the case that the calculated distance difference meets the following conditions, enable the new priority level of the host vehicle: (1) the distance difference is greater than a distance difference threshold; and (2) the distance difference is maintained for a predetermined time period; and in the case that either of the above conditions is not met, enable the previous priority level of the host vehicle.

4. The in-vehicle device according to claim 1, wherein the in-vehicle device comprises a communication interface communicatively connected with the controller; and the in-vehicle device is configured to wirelessly receive via the communication interface the information and the distance.

5. The in-vehicle device according to claim 4, wherein the in-vehicle device is configured to receive the priority level of each vehicle sharing the right-of-way of the intersection via the communication interface; and the controller is further configured to:

judge whether there is a priority level higher than the priority level of the host vehicle based on the received priority levels;

if there is a higher priority level, control the host vehicle to pass the intersection after the vehicle having the higher priority level has passed the intersection; and if there is no higher priority level, control the host vehicle to pass the intersection according to its priority level.

6. The in-vehicle device according to claim 4, wherein the in-vehicle device is configured to receive a navigation path via the communication interface, the navigation path including the information of the intersections through which the host vehicle will pass; or the in-vehicle device is configured to receive the information of the one or more intersections through which the host vehicle will pass, and a navigation path is calculated based on the received information by the host vehicle.

7. The in-vehicle device according to claim 4, wherein the in-vehicle device is configured to receive a vehicle type of each vehicle sharing the right-of-way of the intersection via the communication interface, and the controller is configured to:

determine whether there is a special-use vehicle based on the vehicle type;

if there is a special-use vehicle, control the host vehicle to wait for the special-use vehicle to pass through the intersection; and if there is no special-use vehicle, control the host vehicle to pass the intersection without waiting.

8. The in-vehicle device according to claim 7, wherein the special-use vehicle comprises a vehicle used for a special or emergency task.

9. The in-vehicle device according to claim 7, wherein the special-use vehicle comprises fire engine, ambulance, police vehicle, engineering rescue vehicle and vehicle used for transporting emergency materials.

10. The in-vehicle device according to claim 1, wherein the information of the one or more intersections is provided in a navigation map stored in an external device; and the external device is a remote server configured to wirelessly communicate with the host vehicle, or a roadside facility configured to wirelessly communicate with the host vehicle.

11. The in-vehicle device according to claim 1, wherein the distance between the host vehicle and the intersection is calculated by the controller and sent to the one or more vehicles that are configured to wirelessly communicate with the host vehicle via the communication interface; or the distance between the host vehicle and the intersection is calculated by an external device configured to wirelessly communicate with the host vehicle, transmitted to the host vehicle from the external device, and then sent to the one or more vehicles by the host vehicle; or the distance between the host vehicle and the same intersection is calculated by an external device, and transmitted to the host vehicle and the one or more vehicles from the external device.

12. The in-vehicle device according to claim 1, wherein, after the host vehicle has passed the intersection, the in-vehicle device is configured to control the host vehicle to pass through the next intersection; and once the host vehicle passes the intersection, a new priority level of the host vehicle for the next intersection is calculated.

13. The in-vehicle device according to claim 1, wherein the one or more vehicles are automatic driving vehicles; or the one or more vehicles are equipped with a driving assistance system for automatic driving.

14. The in-vehicle device according to claim 1, wherein the vehicle passing through the intersection means that the vehicle turns or goes straight at a turn of the intersection; and the distance between a vehicle and an intersection is a distance between the vehicle's front end and the turn of the intersection.

15. The in-vehicle device according to claim 1, wherein the distance between a vehicle and an intersection is a distance between a midpoint of the vehicle's front end and a central point of a turn of the intersection, wherein the central point is the intersecting point of a midline of a current lane of travel and a midline of another lane of travel that intersects with the current lane to form the turn.

16. A system for Internet of Vehicle, wherein the system comprises two or more vehicles configured to wirelessly communicate with each other, and each of the vehicles comprises an in-vehicle device of claim 1 to control the vehicle to pass through one or more intersections.

17. A method for controlling a host vehicle to pass through one or more intersections executed by the in-vehicle device according to claim 1, the method comprising:

obtaining information of each of the intersections through which one or more vehicles including the host vehicle will pass and a distance between each of the one or more vehicles and the intersection;

identifying, based on the obtained information, any of the vehicles that will pass through a same intersection as the intersection through which the host vehicle will pass, the identified vehicle as well as the host vehicle being defined as vehicles sharing the right-of-way of the intersection;

determining a priority level of the host vehicle based on an order of the distances between the intersection and the vehicles sharing the right-of-way of the intersection;

judging whether the distance between the host vehicle and the intersection the host vehicle will pass is shorter than or equal to a distance threshold;

in the case that the judgment is affirmative, the priority level of the host vehicle is enabled such that the host vehicle passes through the same intersection maintaining the priority level; and in the case that the judgment is negative, the priority level of the host vehicle is disabled.

* * * * *